United States Patent [19]

Barna

[11] Patent Number: 4,487,566

[45] Date of Patent: Dec. 11, 1984

[54] PUNCHING TOOL HAVING INTERCHANGEABLE PUNCHES

[76] Inventor: Alex J. Barna, 1212 Crawford St., Duquesne, Pa. 15110

[21] Appl. No.: 512,482

[22] Filed: Jul. 11, 1983

[51] Int. Cl.[3] ..... B26D 7/26; B26F 1/14

[52] U.S. Cl. ..... 425/193; 30/367; 83/684; 83/698; 145/61 F; 279/91; 425/345; 425/352

[58] Field of Search ..... 425/345, 351, 352, 353, 425/338, DIG. 35, 443, 193; 83/698, 685, 684, 683, 635, 686; 30/358, 367; 279/91, 96; 145/46, 61 F

[56] References Cited

U.S. PATENT DOCUMENTS

| | | | |
|---|---|---|---|
| 458,076 | 3/1891 | Simmonds | 83/686 |
| 889,409 | 6/1908 | Spalding | 145/61 F |
| 1,507,783 | 9/1924 | Luce | 279/91 |
| 2,675,079 | 4/1954 | Hughes | 30/367 |
| 2,920,913 | 1/1960 | Antila | 403/238 |
| 2,927,492 | 3/1960 | Porter | 83/698 |
| 3,029,512 | 7/1962 | Saxton | 30/367 |
| 3,274,878 | 9/1966 | Vecchi | 83/698 |
| 3,483,831 | 12/1969 | Fujii et al. | 425/345 |
| 3,759,130 | 9/1973 | Patterson | 83/637 |
| 3,935,771 | 2/1976 | Cady, Jr. | 83/140 |
| 4,007,653 | 2/1977 | Cady | 83/140 |
| 4,339,976 | 7/1982 | Wallis | 83/684 |
| 4,355,466 | 10/1982 | Quiring | 30/358 |
| 4,370,119 | 1/1983 | Watanabe | 425/352 |

FOREIGN PATENT DOCUMENTS 61847 10/1973 Australia .

OTHER PUBLICATIONS

Heli-Coil Bulletin 900, "Heli-Coil Screw Thread Inserts Design and Production Manual".

Heli-Coil Bulletin 975, "Screw Thread Inserts for Industrial Maintenance, Repair, and Overhaul".

*Primary Examiner*—Jay H. Woo

*Assistant Examiner*—Tinker R. McBrayer

*Attorney, Agent, or Firm*—Stanley J. Price, Jr.; John M. Adams

[57] ABSTRACT

A punching tool for use in a tablet making machine includes a body portion having at least one bore extending from an end of the holder a preselected distance into the holder. The bore is internally threaded a preselected depth. An interchangeable punch is threaded into the punch holder bore and extends a selected length from the holder. The end of the punch has an externally threaded portion and a cylindrical portion. The cylindrical portion is positioned between the threaded portion and the portion of the punch that extends outwardly from the holder. The cylindrical portion has a diameter that permits it to move freely without interference into and out of the internally threaded bore. The bore has an enlarged thread configuration provided with cylindrical bearing surfaces between threads. The punch threaded portion has a thread configuration corresponding to the configuration of the threaded bore to permit rapid engagement and disengagement of the punch in the bore. The bearing surfaces of the bore stabilize the punch in the bore to maintain the required length of the punch extending from the holder.

16 Claims, 14 Drawing Figures

PRIOR ART

PUNCHING TOOL HAVING INTERCHANGEABLE PUNCHES

BACKGROUND OF THE INVENTION

1. Field of the Invention

This invention relates to a punching tool and more particularly to a tablet making punch having one or more punches connected to a holder in a manner to assure precise connection of the punch to the holder for the tolerances required while permitting rapid changing of a punch on the holder.

2. Description of the Prior Art

Rotary type compressive tablet forming machines are well known in the art and, as illustrated in U.S. Pat. No. 3,483,831, are operable to compressively compact powder, granular and like material into compact tabletlike bodies. The tablets are applicable for the preparation of pharmaceutical, food, chemical and agricultural preparations. As disclosed in the above patent, a rotary-type compressive tablet forming machine includes a series of a plurality of press units. Each unit includes a stationary die with cooperating upper and lower punches. The upper punch is slidable into and out of a die opening within which the lower punch is guided. The press units are continuously moved along a predetermined path and the units are supported on a turntable, which is rotated so that the press units will be continuously moved along a circular path.

In the path of travel of the press units is positioned a pair of stationary upper and lower rollers counter-facing each other. As each press unit passes through the space between the upper and lower rollers, the upper punch engages the curved periphery of the upper roller and is thereby downwardly guided to slide into the upper die opening while the lower punch engages the curved periphery of the lower roller and is thereby upwardly moved to slide within the lower die opening. The material within the die opening is compacted to form a solid tablet.

As soon as the press unit has passed through the space between the rollers, the punches are disengaged from the respective rollers and the compression on the compact body by the punches is released. The upper punch is gradually guided upwardly so as to leave the die, and the lower punch is also guided upwardly to push the solid compact body out of the die opening. Thereafter, the die opening is charged again with new material, and the press unit is further moved to the position of the upper and lower stationary rollers, where the same operation is repeated.

Examples of known punches adaptable for use in tablet forming operations and punch press operations are described in U.S. Pat. Nos. 458,076; 1,507,783; 2,920,913; 2,927,492; 3,274,878; 3,759,130; 3,935,771; 4,007,653 and 4,339,976. An inherent problem in punching operations is the manner in which the punch or insert is removably secured to the holder so as to maintain the required tolerances to assure correct engagement of the punch and the die. It is critical that the punch be of a preselected length so as to extend a preselected distance into the die so that, for example in tablet forming, the required degree of compaction is obtained. After many cycles of use, the punches become worn and the required tolerances are no longer obtainable, requiring that the punches be removed and replaced on the holder.

In one well-known design, a detent arrangement is utilized for securing a punch insert in the punch holder. However, this is considered to be cumbersome because of the space taken up on the holder for the detent arrangement. A similar arrangement is also provided with the well known set screw arrangement for releasably securing a punch to a holder. These types of means for releasably securing a punch to a holder are undesirable because the required tolerances are difficult to maintain for the entire cycle life of the punch.

In the above-discussed tablet forming operation, both the upper and lower punches are similarly supported in punch holders and it is the conventional practice that the known dies include only a single hole because only a single punch is provided on each holder. This limitation is particularly imposed by the means by which the punch is secured to the holder, such as by detent or a set screw arrangement, so that insufficient area is available on the holder for accommodating more than a single punch.

Therefore, there is need, in tablet forming operations, for a punch which is releasably connected to a holder in a manner to facilitate rapid and precise replacement of a punch in the holder, particularly after the punch has become worn and the critical length of extension of the punch in the die is not within the required tolerance. The punch should be easily inserted and removed from the holder, while maintaining the required tolerances for the cycle life of the punch. Further, there is need to increase the productivity in tablet forming operations by providing a multiplicity of punches on a single holder, where each punch is easily inserted and removed and the required tolerances are maintained.

SUMMARY OF THE INVENTION

In accordance with the present invention, there is provided a punching tool, adapted to receive a replaceable punch that includes a punch holder having a body portion with opposite end portions. A bore having an internally threaded portion of a preselected length and diameter extends from one end portion into the handle body portion to a closed end. A punch having an elongated body of a preselected length includes a shank portion adapted for positioning in the bore internally threaded portion and an end portion extending outwardly from the holder end portion. The punch shank portion has an externally threaded portion and a cylindrical portion. The shank cylindrical portion is positioned between the shank threaded portion and the punch end portion extending outwardly from the holder. The shank cylindrical portion is freely movable in the bore internally threaded portion. The punch end portion includes a torque receiving portion adjacent the shank cylindrical portion for rotatably advancing the punch shank portion into the internally threaded bore. The bore internally threaded portion includes internal threads spaced apart by cylindrical bearing surfaces. The punch shank threaded portion has an enlarged thread configuration corresponding to the configuration of the bore internal threads to permit rapid engagement and disengagement of the punch shank threaded portion with the bore internal threads upon rotation of the punch end portion. The bearing surfaces of the bore internally threaded portion stabilize the punch shank portion in the bore to assure positive engagement of the punch shank portion in the internally threaded bore and prevent damage to the meshing threads upon insertion and removal of the punch in the bore.

Accordingly, the principal object of the present invention is to provide a punch holder adapted for receiving a punch and securing the punch to the holder in a manner to facilitate efficient removal and replacement of a punch in the holder.

Another object of the present invention is to provide a punch having an internally threaded bore of a preselected thread configuration adapted to receive the threaded shank of a punch having a corresponding thread configuration in which the cooperating threads in the punch holder bore and on the punch shank are efficiently engaged so as to insure correct location of the punch in the holder to permit rapid insertion and removal of the punch from the holder without stripping the threads in the bore or on the punch.

A further object of the present invention is to provide, for a tablet forming machine, a punch holder adapted to receive a plurality of individual punches releasably engageable in the holder and positioned to extend a desired length from the punch so as to insure the desired degree of compaction of the tablet.

An additional object of the present invention is to provide a punch adaptable for use in tablet forming operations and the like where required tolerances are maintained for the cycle life of the punch which is efficiently secured to and removed from the holder.

These and other objects of the present invention will be more completely disclosed and described in the following specification, the accompanying drawings and the appended claims.

DESCRIPTION OF THE PREFERRED EMBODIMENTS

Figure 1:
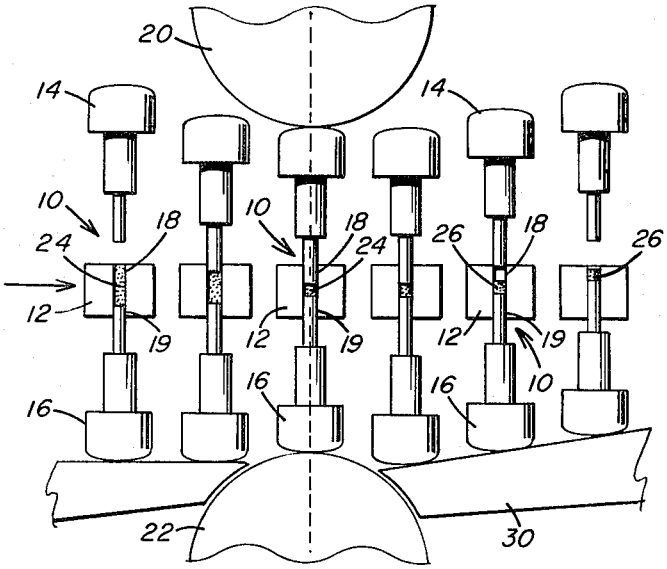
FIG. 1 is a schematic illustration in elevation of a prior art rotary-type tablet forming machine, illustrating a plurality of press units that include a die with cooperating upper and lower punches.

Referring to the drawings, and particularly to FIG. 1, there is diagrammatically illustrated a prior art rotary-type compressive tablet forming machine that includes a series of press units 10, each having a die 12 which is stationary or fixed on the periphery of a turntable (not shown) which, in turn, is rotated at a speed of about 10–50 r.p.m. in the direction indicated by the arrow. Each die 12 is associated with an upper punching tool 14 and a lower punching tool 16. The upper punching tool 14 is adapted to slide into and out of an upper die opening 18 during the travel of the die 12. In the path of travel of the press units 10, there are arranged a a pair of rollers.

A stationary upper roller 20 and a lower roller 22 are positioned in opposed relation to each other with a space therebetween. The press unit 10 is guided by a turntable into and out of the space between the rollers 20 and 22. As the press unit 10 reaches the position of the rollers 20 and 22, the upper punching tool 14 engages the upper roller 20 and is thereby pushed downwardly into the die opening 18 while the lower punching tool 16 engages the lower roller 22 and is thereby lifted into a lower die opening 19. Thus, material 24 within the die 12 is pressed by the upper and lower punching tools 14 and 16 into a solid, compact body 26.

When the punching tools 14 and 16 are closest to each other, the material 24 is most compressed. After the material 24 has been compressed to the desired degree, the punching tools 14 and 16 are disengaged from the respective rollers 20 and 22. The upper punching tool 14 is guided gradually upwardly by means of a guide and guide elements (not shown). The lower punching tool 16 is also guided upwardly by means of a guide rail 30 so that the solid compact body 26 is discharged upwardly out of the die 12.

Figure 2:
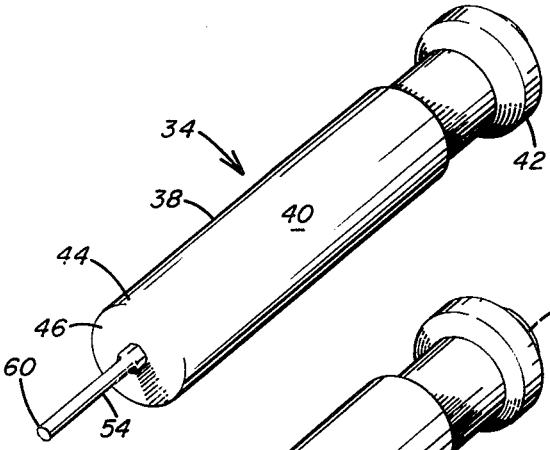
FIG. 2 is an isometric view of one embodiment of a punching tool of the present invention, illustrating a single punch removably engageable with a punch holder.
Figure 3:
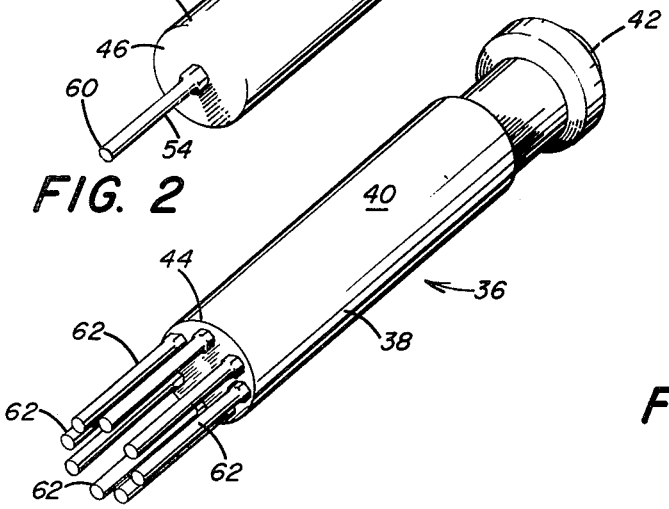
FIG. 3 is a view similar to FIG. 2, illustrating a plurality of individual punches removably engageable with the punch holder.

In accordance with the present invention, die punching tools generally designated by the numerals 34 and 36 in FIGS. 2 and 3 respectively are adaptable for use with the rotary-type tablet forming machine illustrated in FIG. 1 as well as with other known types of tablet forming machines. The punching tools 34 and 36 are operable for use in the tablet forming machine shown in FIG. 1 in place of the upper and lower punching tools 14 and 16 above described. The punching tool 34 illustrated in FIG. 2 includes a single punch similar to the punching tools illustrated in FIG. 1, where a pair of the punching tools 34 is operable to form a single tablet in the die 12. The punching tool 36, illustrated in FIG. 3, is adapted to simultaneously form a plurality of tablets in a die having a plurality of corresponding die openings, so that upon each downward and upward movement of the pair of punching tools 36, a plurality of tablets are formed.

Each punching tool 34 and 36 includes a punch holder 38 having a body portion 40 with a first or head end portion 42 and a second or punch receiving end portion 44. The head end portion 42 is adapted to move into and out of contact with the respective tablet forming machine rollers. The punch receiving end portion 44 has a planar surface 46. For the punching tool 34 illustrated in FIG. 2, there is provided a single threaded bore 48. The punching tool 36 includes a plurality of threaded bores 48 spaced apart. Each bore 48 extends from the planar surface 46 a preselected distance into the respective punch holder body portion 40 and includes internal threads 50, as shown in detail in FIGS. 4 and 8. The bore 48 terminates in a closed end portion 52. For the embodiment of the punching tool 34 including a single bore 48, the bore 48 is preferably centered on the planar surface 46. For the plurality of bores 48 on the punching tool 36 shown in FIG. 3, the bores 48 are preferably positioned on the periphery of the planar surface 46.

Figure 4:
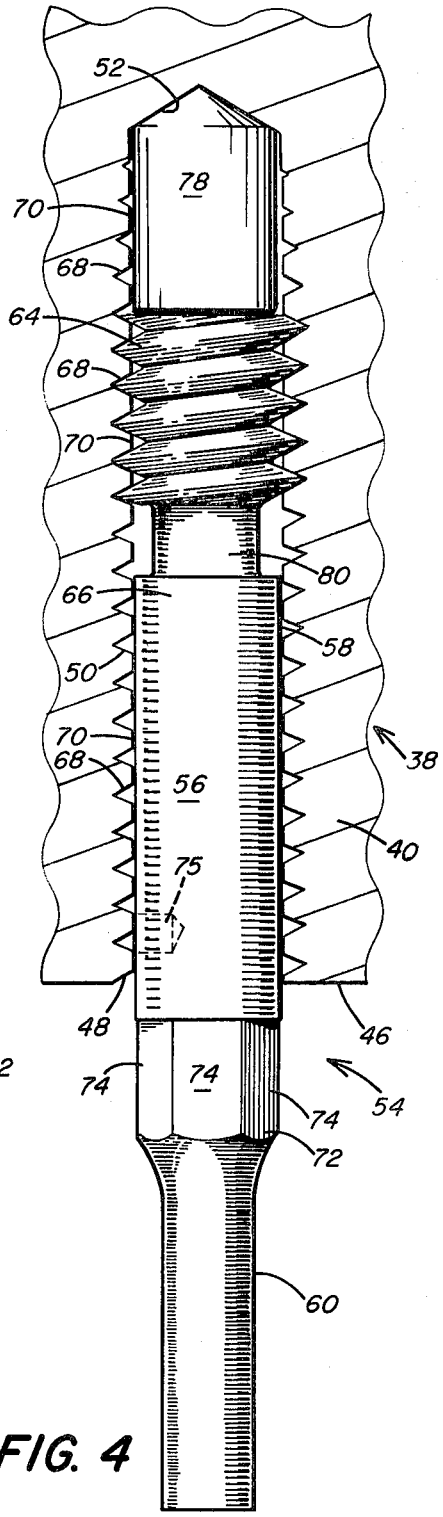
FIG. 4 is an enlarged, fragmentary, sectional view of the threaded bore of the punch holder having an internally threaded bore, illustrating one embodiment of a punch.

A single punch, generally designated by the numeral 54 in FIG. 2 and in greater detail in FIG. 4, has an elongated body 56 of a preselected length including a shank portion 58 adapted for positioning in the bore 48 and an end portion 60 extending out of the bore 48. As will be explained later in greater detail, the punch 54 is quickly inserted in and removed from the punch holder 38 in a manner that maintains the required tolerances for the tablet forming operation. It is extremely important that the punch end portion 60 extends a preselected length from the holder end portion 46 to provide the desired degree of compaction of the material 24 in the die 12, as above described, to form the tablet 26.

The punching tool holder 38 illustrated in FIG. 3, similar to the punching tool 34 illustrated in FIG. 2, includes the elongated body portion 40 having the head end portion 42 and punch receiving end portion 44. As shown in FIG. 3, the planar surface 46 includes a plurality of bores 48 for receiving a plurality of punches 62. Each punch 62 includes the above-described elements for the punch 60 shown in FIG. 4. Thus, each punch 62 includes the elongated body portion 56 having the shank portion 58 received in the respective bores 48 and the end portion 60 projecting from the punch holder 38. With this arrangement, the punches 62 are simultaneously movable into and out of a die having a plurality of die openings for receiving the punches 62.

The punching tool 36 shown in FIG. 3 is illustrated with eight individual punches 62 that are releasably inserted in threaded bores 48. It should be understood that the number of bores provided in a punching tool is selective and is determined by the diameter of the punch holder 38 and the respective diameters of the punches 62. Thus, a punch holder in accordance with the present invention can be provided with any number of punches; for example, from one, as illustrated in FIG. 2, to eight, as illustrated in FIG. 3.

Figure 5:
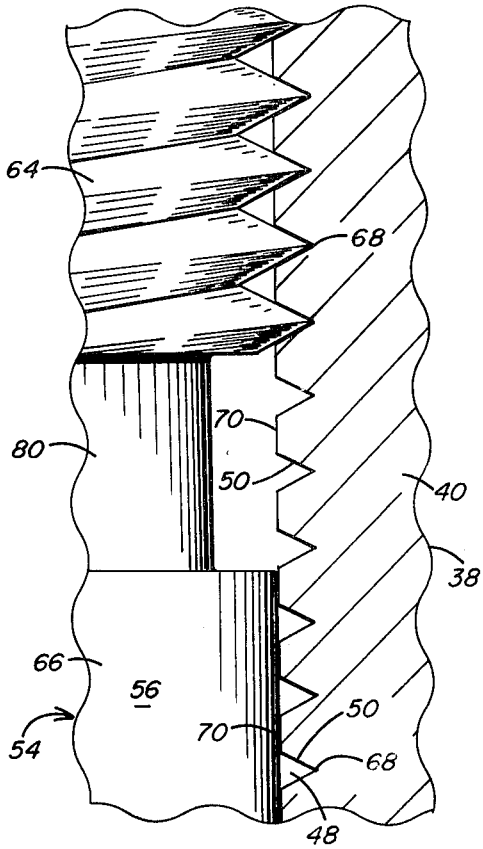
FIG. 5 is an enlarged, fragmentary, sectional view of the embodiment of the punch holder and punch shown in FIG. 4, illustrating the threaded engagement of the punch in the threaded bore of the holder.

Now referring to FIGS. 4 and 5, the features of the punch 54 are shown in greater detail. It should be understood that the punch 54 associated with the punching tool 34, shown in FIG. 2, also corresponds in construction to each of the punches 62 associated with the punching tool 36 shown in FIG. 3. As illustrated in FIG. 4, the punch shank portion 58 has an externally threaded portion 64 and an enlarged cylindrical portion 66 separated from threaded portion 64 by a reduced cylindrical portion 80. The shank cylindrical portion 66 is freely movable without interference into and out of the bore 48. The punch end portion 60 extends from the shank portion 58 out of the bore 48.

Figure 8:
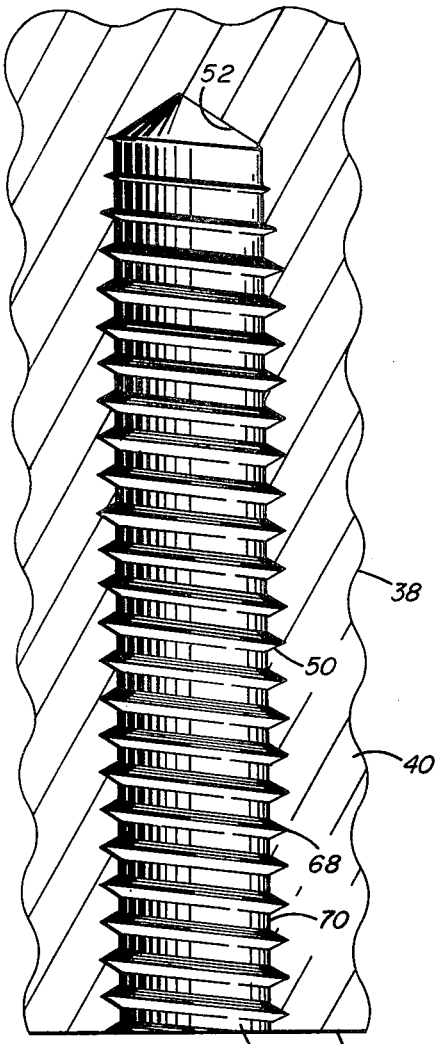
FIG. 8, shown on the sheet with FIG. 6, is an enlarged, fragmentary, sectional view of the internally threaded bore of the punch holder for receiving the punches of the present invention.

The configuration of the enlarged threads 50 of the punch holder bore 48 is separately shown in FIG. 8. The bore 48 has a preselected length that extends from the planar surface 46 of the holder body portion 40 to the closed end portion 52. Preferably, the bore 48 is threaded its entire length from the outer planar surface 46 to the closed end portion 52. In accordance with the present invention, the threads 50 have a preselected configuration in which a plurality of thread roots 68 are separated by crests 70 that have an increased length for forming cylindrical bearing surfaces adapted to facilitate ease of insertion and removal of the punch 54 in the bore 48. This enlarged thread configuration prevents stripping of the punch threaded portion 64. It also facilitates rapid insertion and correct alignment of the punch in the bore 48 so that the punch extends the required length from the holder.

The punch shank threaded portion 64 has an enlarged thread configuration corresponding to the thread configuration of the bore 48. This enlarged thread configuration on the punch 54 and in the punch holder bore 48 permits rapid engagement and disengagement of the punch 54 in the threaded bore 48 upon rotation of the punch end portion 60.

To facilitate rapid insertion and removal of the punch 54 from the punch holder bore 48, the punch end portion 60 is provided with a torque receiving portion 72. The torque receiving portion 72 is positioned adjacent the shank cylindrical portion 66 and is adapted to receive a torque transmitting tool for rotatably advancing the punch threaded portion 64 into the punch holder bore 48. Preferably, the torque receiving portion 72, as illustrated, has a plurality of flats 74, but it should be understood that the portion 72 may have other configurations, for example, a knurled configuration. Also the shank cylindrical portion 66 is provided with a recess for receiving a plug or insert 75, preferably fabricated of nylon and having a diameter equal to the combined axial length of a thread crest and root so as to completely overlie a thread crest as shown in FIG. 4. The function of the insert 75 is to seal off the threaded bore 48 to prevent the entrance of dirt into the bore 48 and, particularly, the thread roots.

In accordance with the present invention, the bearing surfaces formed by the thread crests 70 of the internally threaded bore 48 support the punch shank portion 58 as the shank threaded portion 64 is advanced into threaded engagement with the threads 50 upon rotation of the punch end portion 60. The provision of the enlarged threads in both the bore 48 and on the punch threaded portion 64 assures positive engagement of the punch threaded portion 64 in the internally threaded bore 48. With this arrangement, damage to the threads 64 on the punch 54 and the threads 50 in the bore 48 due to misalignment of the punch 54 in the bore 48 as the punch 54 is initially threadedly advanced into the bore 48 is prevented. Also, by threading only the portion 64 of the entire punch 54, the cost of fabricating the punch 54 is substantially reduced. Furthermore, the cycle life of the punch 54 is substantially increased, and the tolerances required in the tablet forming operation are more closely adhered to.

One of the most important criteria in a tablet forming operation of the type illustrated in FIG. 1 is the length the punch end portion 60 extends from the punch holder end portion 44. This dimension is determined by the length the punch body 56 extends into the punch holder bore 48. To precisely control the positioning of the punch 54 in the bore 48, a plug 78 is positioned as far as possible into the bore 48 at the closed end portion 52. With this arrangement, the punch 54 is threadedly advanced into the bore 48 until the extreme end of the punch threaded portion 64 seats on the plug 78 and the punch can advance no further into the bore 48. This limits the amount of extension of the punch body 56 into the punch holder bore 48. Accordingly, the length of the plug 78 is selected to provide the desired location at which the punch 54 bottoms in the punch holder bore 48 for the desired extension of the punch end portion 60 from the punch holder 38. It is the length of extension of the punch end portion 60 which determines the degree of compaction of the die material 24 in the die 12.

Figure 7:
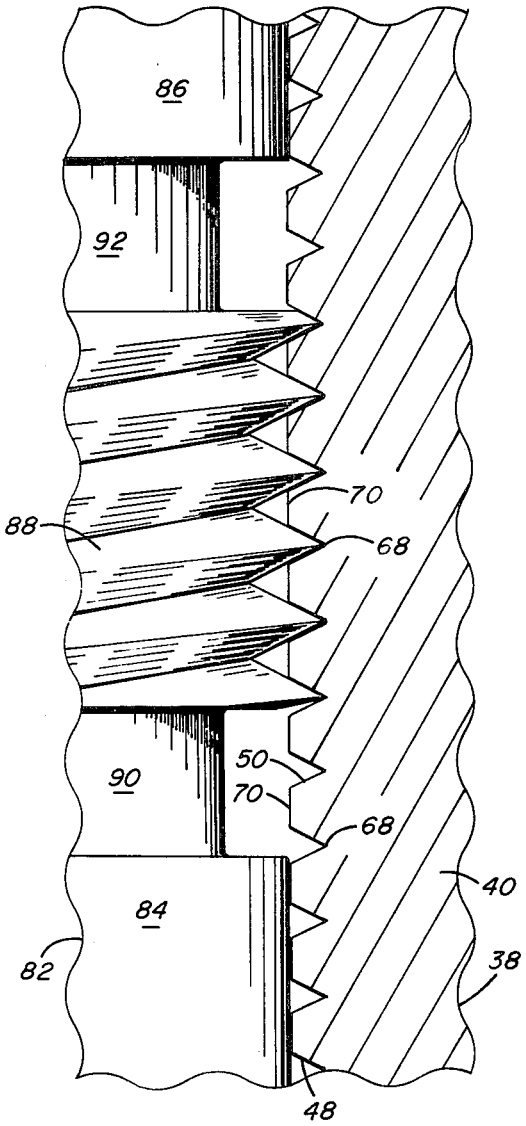
FIG. 7, shown on the sheet with FIG. 5, is an enlarged, fragmentary, sectional view of the threaded connection between the punch and the punch holder illustrated in FIG. 6.
Figure 6:
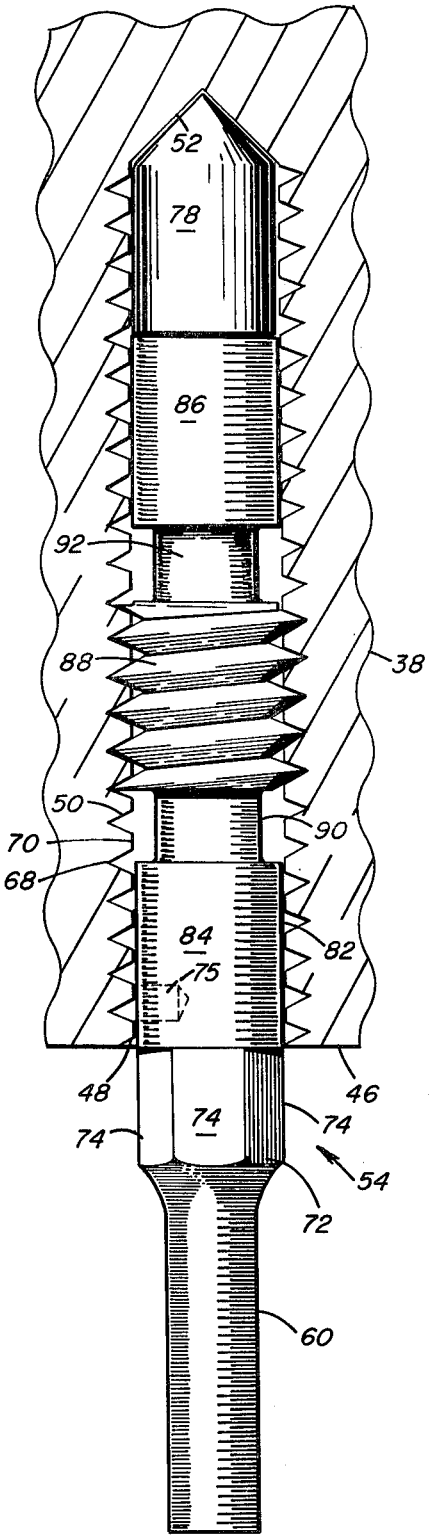
FIG. 6 is a view similar to FIG. 4, illustrating another embodiment of a punch having a threaded portion engageable in the holder threaded bore.

Now referring to FIGS. 6 and 7, there is illustrated another embodiment of the punch 54 that also includes the above-described end portion 60 and torque receiving portion 72. However, the punch 54 shown in FIGS. 6 and 7 includes a shank portion 82 having a pair of enlarged diameter cylindrical portions 84 and 86 separated by a threaded portion 88 in which the ends of the threaded portion 88 are separated from the cylindrical portions 84 and 86 by reduced diameter cylindrical portions 90 and 92. With this arrangement, the punch threaded portion 88 is centered between the cylindrical portions 84 and 86 and, accordingly, the length of the punch shank portion 88, which is threaded, may differ from the length of the embodiment of the punch threaded portion 64 shown in FIG. 4. This threaded arrangement reduces the amount of the punch 54 which is threadedly connected to the punch holder 38 while maintaining the required tolerances for connection of the punch 54 to the punch holder 38.

As with the embodiment illustrated in FIG. 4, the punch 54 illustrated in FIG. 6 also utilizes the plug 78 to form a seat for receiving the cylindrical end portion 86 thereby limiting the extension of the shank portion 82 into the bore 48. This arrangement, in turn, determines the length the punch end portion 60 extends from the end of the punch holder 38. Also, as shown in FIG. 7, the shank threaded portion 88 includes the enlarged thread configuration of the shank threaded portion 64 illustrated in FIG. 5. The shank threaded portion 88, shown in FIG. 7, is engageable with the enlarged threads 50 of the bore 48 where bearing surfaces provided by the extended thread crests 70 between the thread roots 68 securely stabilize the punch 54 in the bore 48 to maintain the length of extension of the punch end portion 60 from the punch holder 38 within the required tolerance. The punch 54 shown in FIG. 6 also utilizes the seal insert 75 discussed above with reference to FIG. 4.

Figure 9:
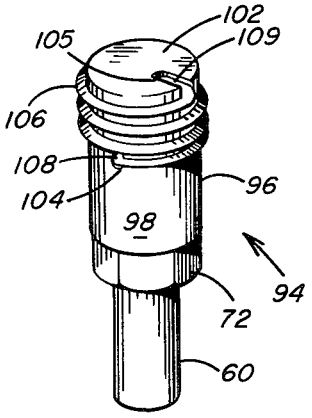
FIG. 9 is an isometric view of another embodiment of a punch for receiving in the punch holder bore, illustrating a screw thread insert secured to the shank of the punch to form the threads on the punch.

Referring to FIG. 9, there is illustrated another embodiment of a punch 94 that is quickly inserted and removed from the punch holder bore 48 shown in FIG. 8. The punch 94, shown in detail in FIGS. 10 and 11, also includes, as above described, the end portion 60 provided with the flats 74 for receiving torque to advance the punch 94 into the punch holder bore 48. The punch holder 38, illustrated in FIGS. 10 and 11, includes a backing plate 95 for receiving the end of the punch 94 in the bore 48. The punch 94 includes a shank portion 96 having a cylindrical portion 98 adjacent the end portion 60 and an externally threaded portion 100 that extends to a blunt end portion 102 of the punch 94. The externally threaded portion 100 has the enlarged thread configuration corresponding to the thread configuration described above and illustrated in FIGS. 4 and 6 for the punch 54.

Figure 11:
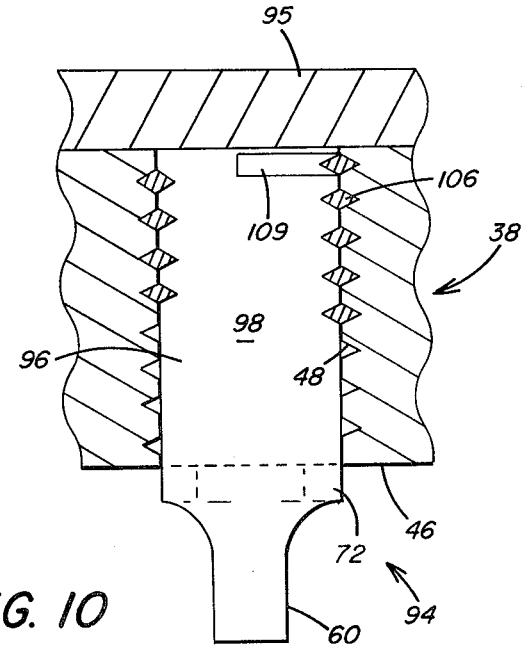
FIG. 11 is an enlarged, fragmentary, sectional view of the punch with the screw thread insert engaged in the punch holder bore shown in FIG. 10.

The punch 94 includes a hole 104 at the base of the externally threaded portion 100 on the surface of the cylindrical portion 98, extending a preselected distance therein, and a transverse slot 105, shown in FIG. 9, at the end portion 102. The externally threaded portion 100 is adapted to threadedly receive a screw thread insert 106 having a thread configuration adapted to be received on the punch externally threaded portion 100. The screw thread insert 106 includes end portions 108 and 109 adapted to extend into the hole 104 and slot 105, respectively, so as to axially secure the screw thread insert 106 on the punch externally threaded end portion 100. In this manner, the screw thread insert 106 is retained on the punch 94 to move into and out of threaded engagement with the internally threaded bore 48 of the punch holder 38 as shown in FIG. 11. The punch 94 is advanced into the bore 48 until the punch end portion 102 seats against the backing plate 95 at the end of the bore 48.

As further illustrated in FIG. 11, the screw thread insert 106 is axially fixed and secured to the punch 94 so as to engage the internally threaded bore 48. Thus, the screw thread insert 106 is connected to the punch 94 to, in turn, connect the punch 94 to the punch holder 38 in a manner to facilitate efficient placement of the punch 94 in the bore 48. The screw thread insert 106 engages a substantial contact surface of the internally threaded bore 48 to securely connect the punch 94 to the punch holder 38.

The provision of the enlarged thread configuration of the screw thread insert 106 serves to efficiently connect the punch 94 to the holder 38 for movement of the punch 94 into and out of the threaded bore 48. This arrangement assures positive engagement of the punch 94 in the punch holder 38. The enlarged thread design of the screw thread insert 106 also facilitates rapid engagement and disengagement of the punch 94 into and out of the punch holder bore 48.

Figure 10:
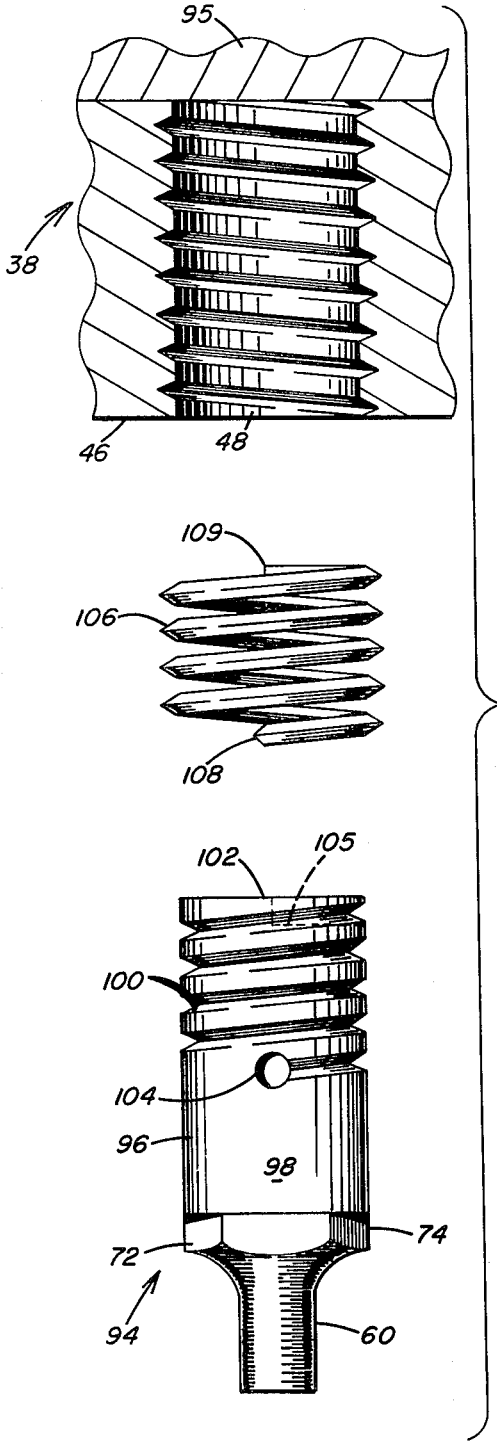
FIG. 10 is an enlarged, exploded, fragmentary, sectional view of the embodiment of the punch shown in FIG. 9 adapted to receive a screw thread insert, which is engageable with the internally threaded bore of the punch holder.
Figure 13:
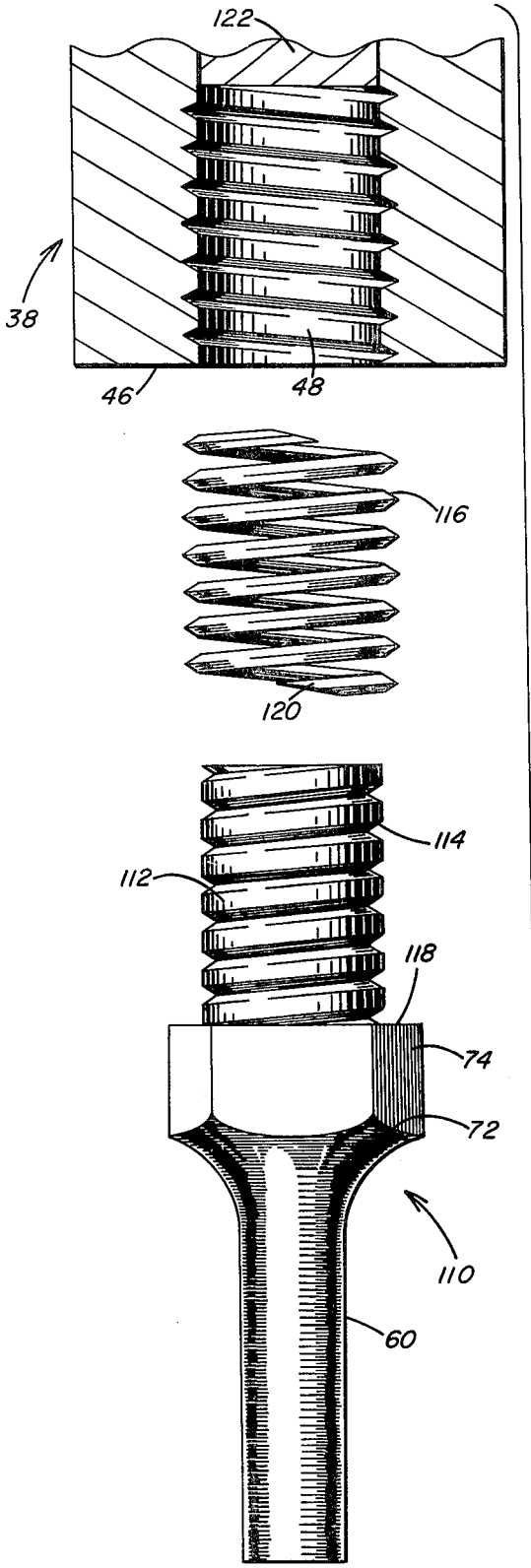
FIG. 13 is an enlarged, exploded, fragmentary, sectional view, illustrating a screw thread insert, which is threadedly advanced onto the threaded end of the punch, and the punch is threaded into the bore of the holder.
Figure 12:
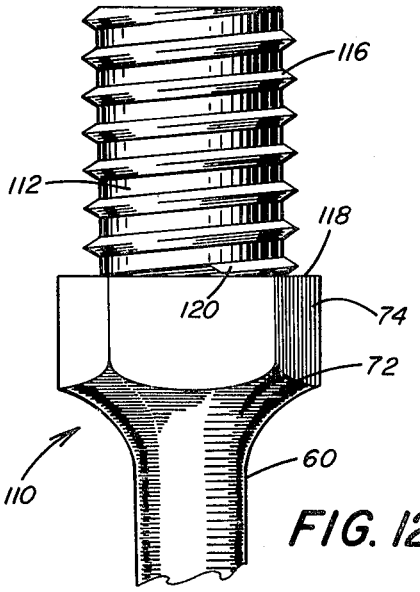
FIG. 12 is an enlarged, fragmentary view of a further embodiment of a punch utilizing a screw thread insert to form the threads on the end of the punch.
Figure 14:
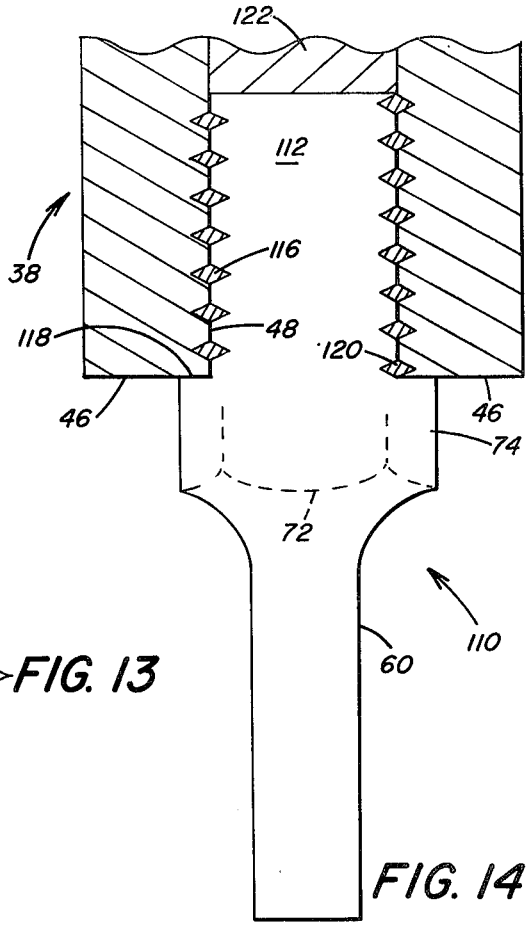
FIG. 14 is a schematic illustration of the threaded connection of the punch shown in FIG. 12 in the punch holder bore shown in FIG. 13.

An arrangement similar to the embodiment shown in FIGS. 10 and 11 is illustrated in FIGS. 12, 13 and 14. In FIG. 13, there is illustrated a punch generally designated by the numeral 110 that includes the abovediscussed features of the end portion 60 integrally connected to a torque receiving portion 72 having a plurality of flats 74. Extending from the end portion 74 of the punch 110 is a shank portion 112 that is externally threaded to provide the enlarged threads 114 that extend the full length of the shank portion 112. The shank portion 112 has the same enlarged thread design discussed above with regard to the embodiments illustrated in FIGS. 4, 6 and 10.

Similar to the embodiment illustrated in FIG. 10, the embodiment illustrated in FIG. 13 also includes a screw thread insert 116 having a diameter and thread configuration adapted to be threadedly advanced onto the punch shank portion 112. FIG. 12 illustrates the screw thread insert 116 fully advanced onto the punch shank portion 112. The entire length of the shank portion 112 is provided with an externally threaded surface corresponding to the thread configuration of the screw thead insert 116.

To facilitate the complete engagement of the screw thread insert 116 on the shank portion 112, the torque receiving end portion 72 of the punch 110 is provided with an enlarged shoulder 118 which serves as a stop for receiving a lower end 120 of the screw thread insert 116. Thus, the screw thread insert 116 is threadedly advanced on the punch threaded shank portion 112 until the insert end portion 120 abuts the enlarged shoulder 118. At this point of engagement, the screw thread insert 116 is in the desired position on the shank portion 112.

The punch 110 having the screw thread insert 116 secured thereon, is adapted for threaded insertion into the internally threaded bore 48 of the punch holder 38, as shown in FIG. 14. The end of the punch 110 is aligned with the bore 48 opposite the planar surface 46, and the punch 110 is rotatably advanced into the punch holder internally threaded bore 48. The thread configuration of the screw thread insert 116 matches the thread configuration of the internally threaded bore 48 so that the punch 110 is threadedly advanced into engagement with the punch holder 38. The punch 110 is advanced into the punch holder 38 until the end of the punch 110 strikes a spring stop 122 forming the closed end portion of the bore 48.

With the present invention disclosed in FIGS. 12–14 and also discussed above in regard to the other embodiments, the enlarged thread design provided on the punch and within the bore of the punch holder securely stabilizes the punch in the punch holder while facilitating rapid insertion and removal of the punch relative to the punch holder without damage to either the threads on the punch or the threads in the bore of the holder. This manner of connection of the punch to the punch holder maintains the required tolerances for the punching operation for the complete cycle life of the punch.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A punching tool adapted to receive a replaceable punch comprising, a punch holder having a body portion with one end portion and a second end portion, a bore having an internally threaded portion of a preselected length and diameter extending from said one end portion into said punch holder to a closed end, a punch having an elongated body of a preselected length including a shank portion positioned in said bore internally threaded portion and an end portion extending outwardly from said holder one end portion, said punch shank portion having an externally threaded portion and a cylindrical portion, said cylindrical portion being positioned between said shank portion threaded portion and said punch end portion, said cylindrical portion being freely movable in said bore internally threaded portion, said punch end portion including a torque receiving portion adjacent said cylindrical portion for rotatably advancing said punch shank portion into said bore internally threaded portion, said bore internally threaded portion including internal threads having a preselected configuration formed by a plurality of thread roots being separated by crests, said crests having a cylindrical shape to form cylindrical bearing surfaces between said thread roots, said punch portion shank externally threaded portion including threads having an enlarged thread configuration corresponding to the configuration of said bore internal threads to permit rapid engagement and disengagement of said punch shank portion externally threaded portion with said bore internal threads upon rotation of said punch end portion, and said threads of said punch portion shank externally threaded portion being engageable with said bore internal threads such that said cylindrical bearing surfaces of said bore internally threaded portion receive said punch shank portion to stabilize said punch shank portion in said bore to assure positive engagement of said punch shank portion in said internally threaded bore and prevent damage to the meshing threads upon insertion and removal of said punch in said bore.

2. A punching tool as set forth in claim 1 which includes, stop means positioned in said bore adjacent said bore closed end portion for forming a seat for receiving said punch shank portion, said punch shank portion including an end portion positioned in said bore, and said punch shank portion being threadedly advanced into said bore until said punch end portion abuts said stop means to limit further movement of said punch into said bore.

3. A punching tool as set forth in claim 2 in which, said stop means includes a plug located in a preselected position in said bore such that abutment of said punch with said plug in said bore positions said punch for a preselected length of said punch end portion to extend from said holder.

4. A punching tool as set forth in claim 1 in which, said punch shank portion cylindrical portion includes a reduced diameter portion, and said punch shank portion externally threaded portion extending from said reduced diameter portion to the end of said shank portion in said holder bore so that said punch shank portion cylindrical portion is separated from said externally threaded portion by said reduced diameter portion.

5. A punching tool as set forth in claim 1 in which, said torque receiving portion is positioned between said punch shank portion and said punch end portion extending from said punch holder, and said torque receiving portion being formed by a plurality of planar surfaces for receiving a rotational force for advancing and retracting said punch into and out of said bore in said punch holder.

6. A punching tool as set forth in claim 1 in which, said punch holder includes a plurality of said bores spaced from one another in spaced parallel relation and extending a preselected depth into said punch holder body portion, and a plurality of said punches being releasably engageable in said bores respectively to provide said punch holder with a plurality of said punches each extending a preselected distance from said punch holder.

7. A punching tool as set forth in claim 1 in which, said punch shank portion cylindrical portion includes an end portion extending to a position adjacent said punch holder bore closed end, said punch shank portion externally threaded portion being centered on said punch shank portion cylindrical portion, said punch shank portion externally threaded portion having opposite end portions, and said punch shank portion cylindrical portion having a pair of reduced diameter portions connected to said opposite end portions of said punch shank portion externally threaded portion.

8. A punching tool as set forth in claim 1 in which, said punch shank portion externally threaded portion is formed by a screw thread insert threaded in a fixed axial position on said punch shank portion, and said screw thread insert having one end portion secured to said punch shank portion and an opposite end portion extending the length of said punch shank portion in threaded engagement with said punch holder bore to a position adjacent said bore closed end.

9. A punching tool as set forth in claim 1 in which, said punch shank portion externally threaded portion is formed by a screw thread insert threaded in a fixed axial position on said punch shank portion, said punch end portion torque receiving portion including an enlarged shoulder forming a stop for receiving one end of said screw thread insert on said punch shank portion, and said screw thread insert extending from said enlarged shoulder the length of said punch shank portion in threaded engagement with said punch holder bore to a position adjacent said bore closed end.

10. A punching tool as set forth in claim 9 in which, said punch shank portion is threadedly advanced into said punch holder bore until said enlarged shoulder abuts said punch holder one end portion preventing further advancement of said punch shank portion into said holder bore.

11. A punch for removable insertion in a holder comprising, an elongated body of a preselected length including a shank portion and a punching end portion extending outwardly from said shank portion for delivering an impact force, said shank portion having an externally threaded portion and a cylindrical portion, said shank portion cylindrical portion being positioned between said threaded portion and said punching end portion and extending a preselected length therebetween to stabilize said shank portion for precise location of said punching end portion relative to a holder, said punching end portion including a torque receiving portion adjacent said cylindrical portion for imparting a rotational force to said shank portion, and said shank portion threaded portion having an enlarged thread configuration for permitting rapid engagement and disengagement of said shank portion threaded portion in a holder.

12. A punching tool as set forth in claim 11 in which, said shank portion cylindrical portion includes a reduced diameter portion, and said externally threaded portion extending from said reduced diameter portion so that said shank portion cylindrical portion is separated from said threaded portion by said reduced diameter portion.

13. A punching tool as set forth in claim 11 in which, said torque receiving portion is positioned between said shank portion and said punching end portion, and said torque receiving portion being formed by a plurality of planar surfaces for receiving a rotational force for advancing and retracting said punch shank externally threaded portion into and out of a holder.

14. A punching tool as set forth in claim 11 in which, said shank portion cylindrical portion includes an end portion, said shank portion threaded portion being centered on said shank portion cylindrical portion, said shank portion threaded portion having opposite end portions, and said shank portion cylindrical portion having a pair of reduced diameter portions connected to said opposite end portions of said shank portion threaded portion.

15. A punching tool as set forth in claim 11 in which, said shank portion externally threaded portion is formed by a screw thread insert threaded in a fixed axial position on said shank portion, and said screw thread insert having one end portion secured to said shank portion and an opposite end portion extending the length of said shank portion.

16. A punching tool as set forth in claim 11 in which, said shank portion externally threaded portion is formed by a screw thread insert threaded in a fixed axial position on said shank portion, said torque receiving portion including an enlarged shoulder forming a stop for receiving one end of said screw thread insert on said shank portion, and said screw thread insert extending from said enlarged shoulder the length of said shank portion.

* * * * *